US005487284A

United States Patent [19]

Kim et al.

[11] Patent Number: 5,487,284

[45] Date of Patent: Jan. 30, 1996

[54] WASHING MACHINE HAVING PUNCH-WASHING FUNCTION

[75] Inventors: Jung H. Kim; Hae Y. Chung; Hyung S. Kim; Byeong H. Lee; Young H. Roh, all of Seoul, Rep. of Korea

[73] Assignee: Goldstar Co., Ltd., Seoul, Rep. of Korea

[21] Appl. No.: 235,513

[22] Filed: Apr. 29, 1994

[30] Foreign Application Priority Data

| | | | |
|---|---|---|---|
| Apr. 29, 1993 | [KR] | Rep. of Korea | 1993-6986 |
| Jul. 26, 1993 | [KR] | Rep. of Korea | 1993-13986 |
| Jul. 26, 1993 | [KR] | Rep. of Korea | 1993-13987 |
| Jul. 28, 1993 | [KR] | Rep. of Korea | 1993-14446 |
| Jan. 26, 1994 | [KR] | Rep. of Korea | 1994-1387 |
| Feb. 18, 1994 | [KR] | Rep. of Korea | 1994-2955 |

[51] Int. Cl.[6] ..... D06F 37/30

[52] U.S. Cl. ..... 68/3 SS; 68/131; 68/133; 74/57

[58] Field of Search ..... 68/131, 133, 355; 74/22 A, 55, 57, 60; 366/118, 128, 113

[56] References Cited

U.S. PATENT DOCUMENTS

| | | | |
|---|---|---|---|
| 2,430,211 | 11/1947 | Cheney | 68/131 |
| 3,678,714 | 7/1972 | Krolzick | 68/131 |
| 4,193,275 | 3/1980 | Bochan | 68/133 |
| 4,452,054 | 6/1984 | Hafstrom . | |
| 4,520,638 | 6/1984 | Brenner | 68/133 |

*Primary Examiner*—Frankie L. Stinson

[57] ABSTRACT

The invention relates to a pulsator with an improved structure and more particularly to a pulsator having punching function used in the washing machine. The pulsator of the present invention is composed of such improved structure that a rotating member has a guiding dimple formed on the its upper end surface, and an elevating member has a guiding protrusion projected from the inner surface. According to such pulsator, non-symmetrical water flow and up-and-down water flow can be generated easily so that the entanglement of the washing articles can be minimized, and the washing is carried out effectively.

5 Claims, 10 Drawing Sheets

WASHING MACHINE HAVING PUNCH-WASHING FUNCTION

BACKGROUND OF THE INVENTION

The present invention relates to washing machine and move particularly to a washing machine having punch-washing function to reduce the damage of washing article caused by mutual rubbing between the washing article and the pulsator of the washer during washing cycle, and to prevent the wash articles from being entangled with each other, by using up-and-down water flow or non-symmetrical heart-shaped water flow which is generated by the rotation of the pulsator so as to improve the washing effect.

Up to now, many attempts have been made to change the shapes and structures of the pulsator of the washing machines in various forms, for example, bar type, disc type and agitator type, for the purpose of improving the washing effect or preventing the washing articles from being entangled with each other.

FIG. 1 illustrates in detail one of the conventional disc type pulsator 10, which comprises a fixing part 11 formed at the center of the lower end portion thereof a protrusion 12 upwardly projected from the center of the upper end with predetermined height, and smoothly curved blades 13 extending from the central portion to the outer periphery.

This type of pulsator 10, as shown in FIG. 2, is mounted in the inside of a wash tub 20 as to be rotated by a driving motor 30. When the power is on, it rotates back and forth and further blades 13 thereof create the water flow indicated by the arrow in FIG. 2. In addition, the washing articles are being laundered by following aforementioned water flow in the wash tub 20.

However, in a washing machine provided with this pulsator 10, the washing articles being gathered to the central portion of the pulsator 10 and located only at the bottom of the wash tub 20 due to water flows towards the central portion of the pulsator while the pulsator is continued to rotate. Therefore, there is a problem that the washing articles are rubbed with the blades 13 of the pulsator 10 and damaged or even torn by it. In addition, the washing articles are being entangled with each other according to the directional change of the rotation of the pulsator, and thus such pulsator has a problem in that it is impossible to expect a high washing effect due to the entanglement of the washing articles and necessary to disentangle the washing articles after dehydrating.

SUMMARY OF THE INVENTION

It is an object of the present to provide a new type pulsator having an elevating member adapted to push up the washing articles by up-and-down motion during washing cycle, wherein the elevating member is formed at the central portion of the pulsator and repeatedly moves upwards and downwards repeatedly along a spiral groove engraved on the outer surface of a rotating member.

It is another object of the present invention to provide a pulsator in which spring means is provided in the elevating member of the pulsator so as to generate up-and-down water flow smoothly in the wash tub.

It is further another object of the present invention to provide a pulsator which are provided with an elevating member oscillating vertically by the rotation of a rotating shaft and a head swingably fixed to the upper end of said elevating member so that washing operation is carried out without entanglement of the washing articles.

It is further another object of the invention to facilitate the creation of non-symmetrical water flow in the wash tub so as to improve the washing power of the washer.

It is further another object of the present invention to increase the frictional force of the elevating member against the water flow so as to facilitate up-and-down motion of the elevating member.

According to the present invention, it is possible to prevent the washing articles from being damaged since the washing articles are being moved upwards and downwards by the pulsator having elevating member. Also, in the washing machine provided with the pulsator according to the present invention, since the washing operation is carried it can be achieved drastically improved effect.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
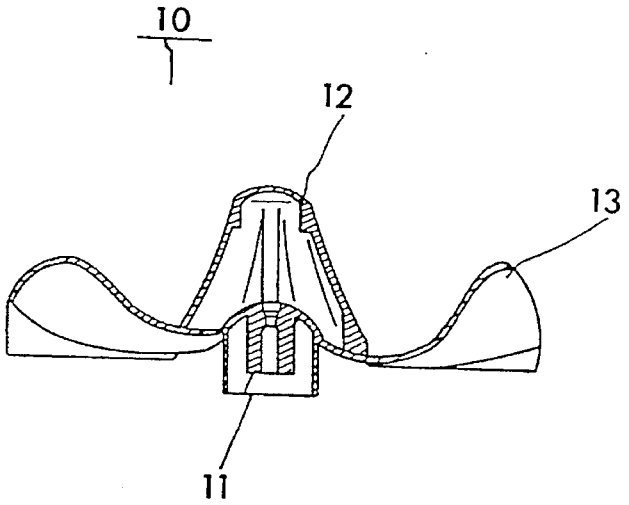
FIG.1 PRIOR ART
FIG. 1 is a cross sectional view showing a conventional pulsator.
Figure 2:
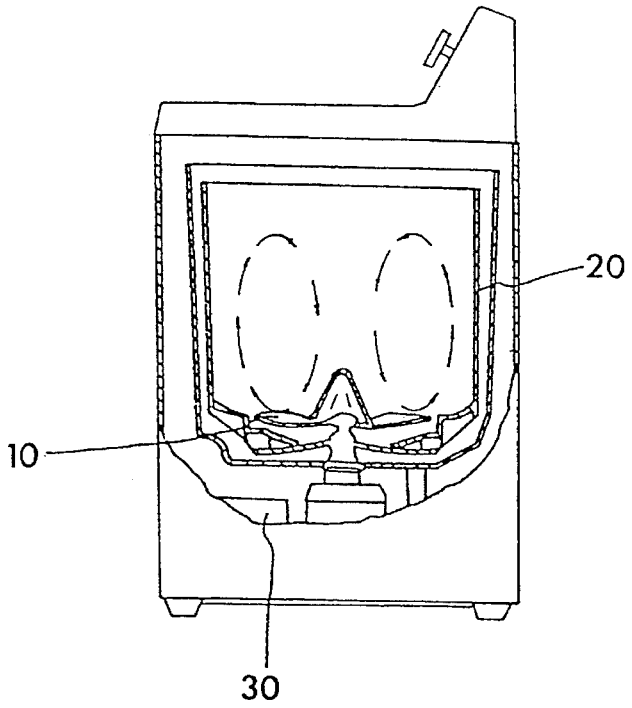
FIG.2 PRIOR ART
FIG. 2 is a partially cutaway view showing flow line of the washing water in a washing machine having a conventional pulsator.
Figure 3:
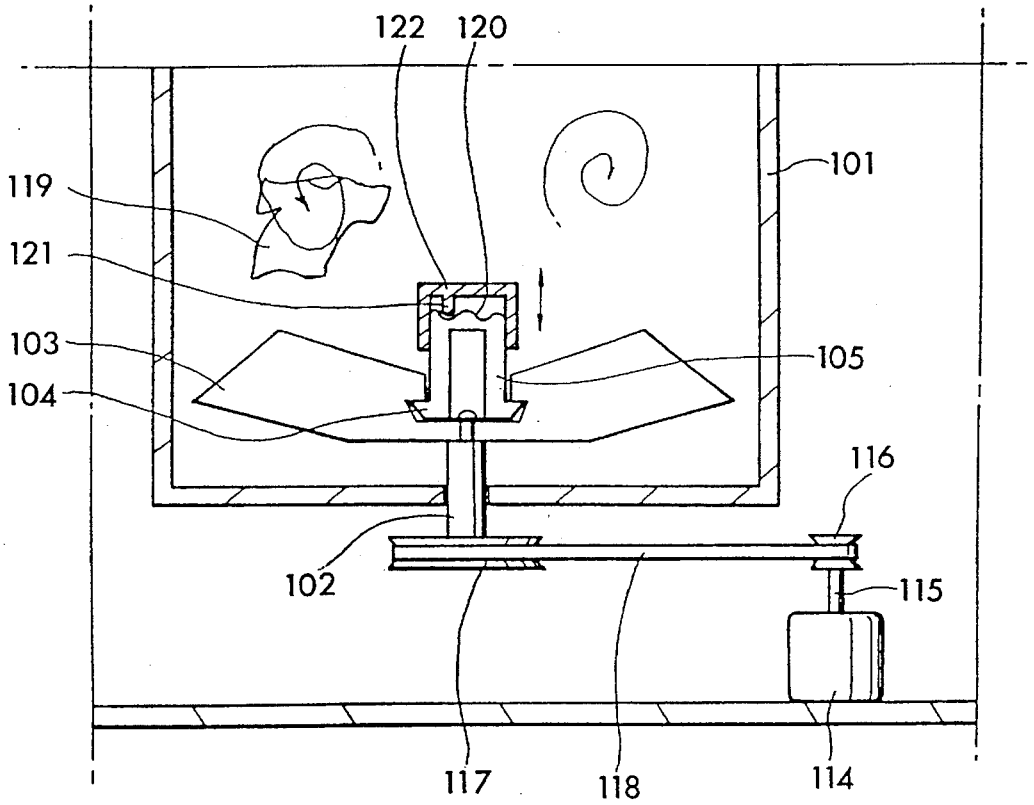
FIG. 3 is a cross sectional view showing operating state in a washing machine of the first embodiment according to the present invention.
Figure 4:
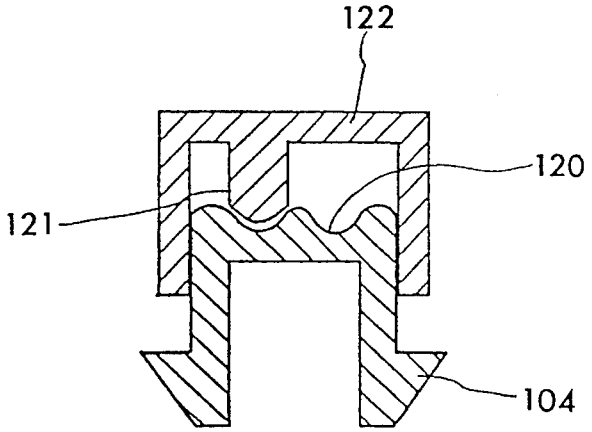
FIG. 4 is a enlarged sectional view showing the engagement of an elevating member and a rotating member in FIG. 3.

The first embodiment of the present invention will be described in detail with reference to FIGS. 3 and 4. Referring to FIG. 3, in a wash tub 101 there is mounted vertically a rotating shaft 102 driven by the driving force of a driving motor 114 which is transmitted through a pulley 116, a belt 118 and a pulley 117, and to the rotating shaft 102 is mounted a pulsator 103 as to be rotated to generate water flow in the wash tub 101. To the central portion of the pulsator 103 is inserted a rotating member 105 by using a fixing part 104 formed at the lower portion thereof, and a dimple 120 is formed on the upper end of the rotating member 105. In addition, the rotating member 105 is coupled with an elevating member 122 to generate heart-shaped water flow in the wash tub 101, wherein the elevating member 122 is provided with a guiding protrusion 121 being contacted with said dimple 120 so as to move along the surface of said dimple 120.

Therefore, when the driving motor 114 starts to rotate, the driving force of the driving motor 114 is transmitted to the rotating shaft 102 through the pulley 116 mounted on the upper end of the motor shaft 115, the belt 118 and the pulley 117 mounted on the lower end of the rotating shaft 102, and the pulsator 103 which is coupled with the rotating member 105 mounted on the upper end of the shaft 102 begins to rotate. At the same time, the guiding protrusion 121 projected from the inside of the elevating member 122 moves along the surface of the dimple 120, so that the elevating member begins to move upwards and downwards so as to push up the washing articles. Thus, the washing operation is to be completed without entanglement of the washing articles.

Figure 5:
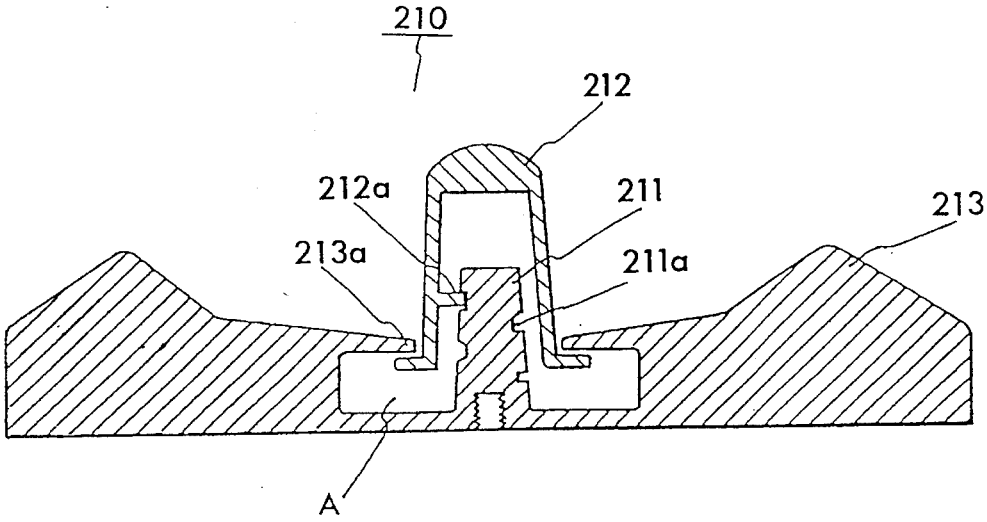
FIG. 5 is a section view of the pulsator of the second embodiment.

Next, the second embodiment of the present invention will be described in detail with reference to FIG. 5 through FIG. 7. FIG. 5 is a sectional view showing a pulsator according to the present embodiment, and FIG. 6 is a partial perspective view illustrating the operating relation between the elevating member and the rotating member.

Figure 6:
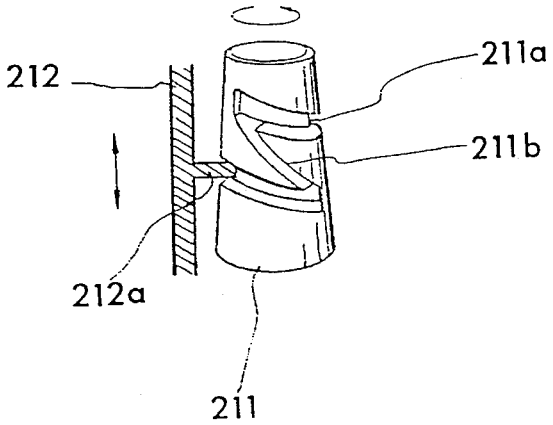
FIG. 6 is a partial perspective view illustrating the operating relation between the elevating member and the rotating member in the second embodiment.

Referring to FIG. 5 and FIG. 6, the rotating member 211 having a scroll groove 211*a* engraved on the surface is projected upwardly from the central portion of the pulsator, and the elevating member 212 is disposed over the rotating member to move upwards and downwards along the scroll groove 211*a*.

Figure 7:
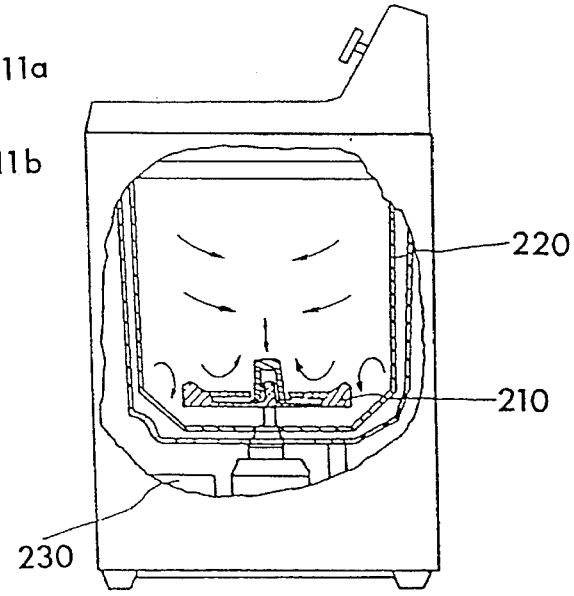
FIG. 7 is a partially cutaway view showing flow line of the washing water in a washer having the pulsator of the second embodiment.

In the present embodiment, as shown in FIG. 7, when the pulsator 210 starts to rotate, the washing water in the wash tub 220 flows along the flow line indicated by the arrow, and the elevating member 212 repeatedly moves upwards and downwards along the scroll groove 211*a* so as to push up the washing articles. Thus, gathering of the washing articles to the central portion of the pulsator can be prevented.

At the central portion of the pulsator, there are formed an operating space A between the insides of blades 213 and the outer surface of the rotating member 211, and an inward flange 213*a* extending from the inside of the blades 213 formed at the upper portion of the operating space A. And there are formed the scroll grooves 211*a* in a predetermined angle on the surface of the rotating member 211, and a returning groove 211*b* is formed between the upper scroll groove and the lower scroll groove.

On the other hand, the elevating member 212 disposed over the rotating member 211 has a hollow part in which the rotating member 211 is received, and at the inner peripheral surface of the elevating member 212 is formed a sliding protrusion 212*a* adapted to be inserted into the scroll groove 211*a*, and an outward flange is formed on the skirt of the elevating member so as to engage with the inward flange 213*a*.

In this pulsator 210 according to the second embodiment, the sliding protrusion 212*a* of the elevating member 212 is engaged with the scroll groove 211*a* and the lower end of the elevating member 212 is rotating into the operating space. As the rotating member 211 rotates, the sliding protrusion 212*a* moves upwards along the scroll groove 211*a* and moves downwards to the lower scroll groove through a returning groove 211*b* after reaching to the upper end of the scroll groove 211*a*, and repeats this operation as long as the pulsator rotates. And the elevating member 212 being moved along the scroll groove 211*a* is contacted with the inward flange 213*a* and restricted upward motion thereof by the flange 213*a*, so that separating of the member 212 from the operation space A can be prevented.

In this embodiment, it is possible to present the washing articles from being damaged since the washing articles being concentrated to the bottom of the wash tub 220 are pushed up by the elevating member.

Figure 8:
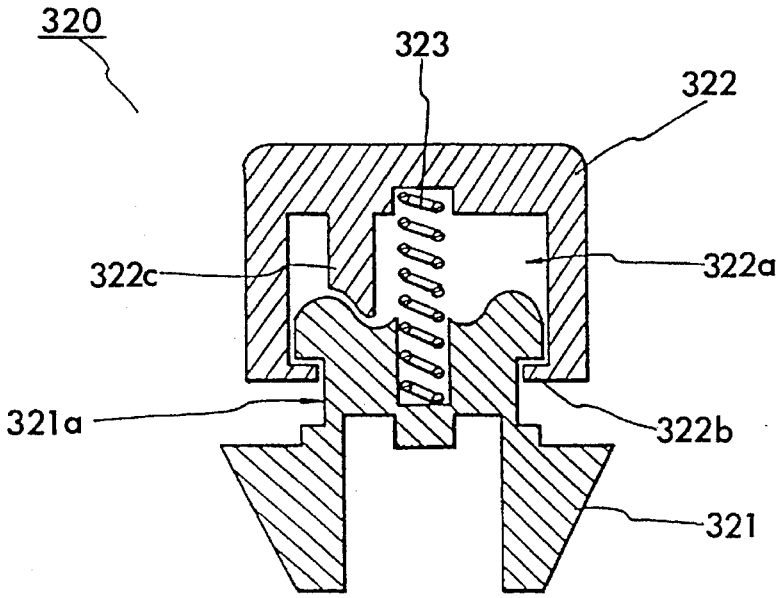
FIG. 8 is a sectional view showing a assembling state of the rotating member and the elevating member of the third embodiment.

Next, the third embodiment of the present invention will be explained with reference to FIG. 8 and 9. FIG. 8 is a sectional view illustrating the assembled state of the rotating member and the elevating member, and FIG. 9 is a schematic view showing flow line of the washing water due to the rotation of the pulsator.

Figure 9:
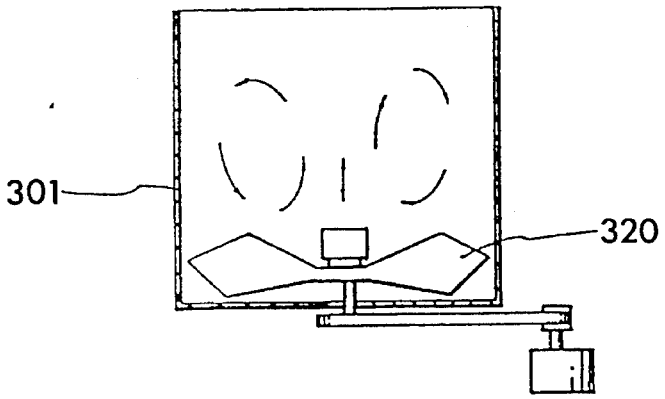
FIG. 9 is a cross sectional view illustrating flow line of the washing water due to the rotating of the pulsator of the third embodiment.

Referring to FIG. 8 and 9, the pulsator 320 includes the rotating member 321 which has a sliding portion 321*a* formed on its upper outer surface and a guiding dimple formed on its upper end surface, the elevating member 322 whose lower end portion is slidably contacted with the sliding portion 321*a* of the rotating member 321, and a coil spring 323 which is elastically supported between the upper end of the rotating member 321 and the inner bottom surface of the elevating member 322.

The upper end of the rotating member 321 is inserted into the hollow portion of the elevating member 322, and the skirt of the elevating member 322 extends to the hollow portion 322*a* so as to form an inward flange 322*b*. The upper portion-of the rotating-member 321 is inserted into the hollow portion 322*a* through the open end of the elevating member 322, and a sliding protrusion 322*c* projected downwardly from the inner surface of the member 322 is slidably contacted with the guiding dimple formed on the upper surface of the member 321 and slidably contacted with the sliding portion 321*a*.

In the above described embodiment, as shown in FIG. 9, when the pulsator 320 begins, to rotate back and forth, the heart-shaped water flow is generated in the water filled in the wash tub 301, and the elevating member 322 moves upwards and downwards along the guiding dimple formed on the upper surface of the rotating member 321 being rotated together with the pulsator 320. At this time, if the pressure of the washing articles and the washing water which flows along the flow line exceeds biasing force of the coil spring 323, the coil spring 323 is compressed and then the elevating member 322 moves downwards, if the biasing force of the coil spring is larger than said pressure, the coil spring is restored to the original state so that the elevating member 322 is moved upwards instantaneously.

In this type of pulsator, the elevating member 322 elastically supported by the coil spring 323 repeatedly moves upwards and downward according to variation of said pressure. Therefore, up-and-down water flow can be easily and smoothly generated through the motion of the elevating member 322 so that the entanglement of the washing articles is prevented.

Figure 10:
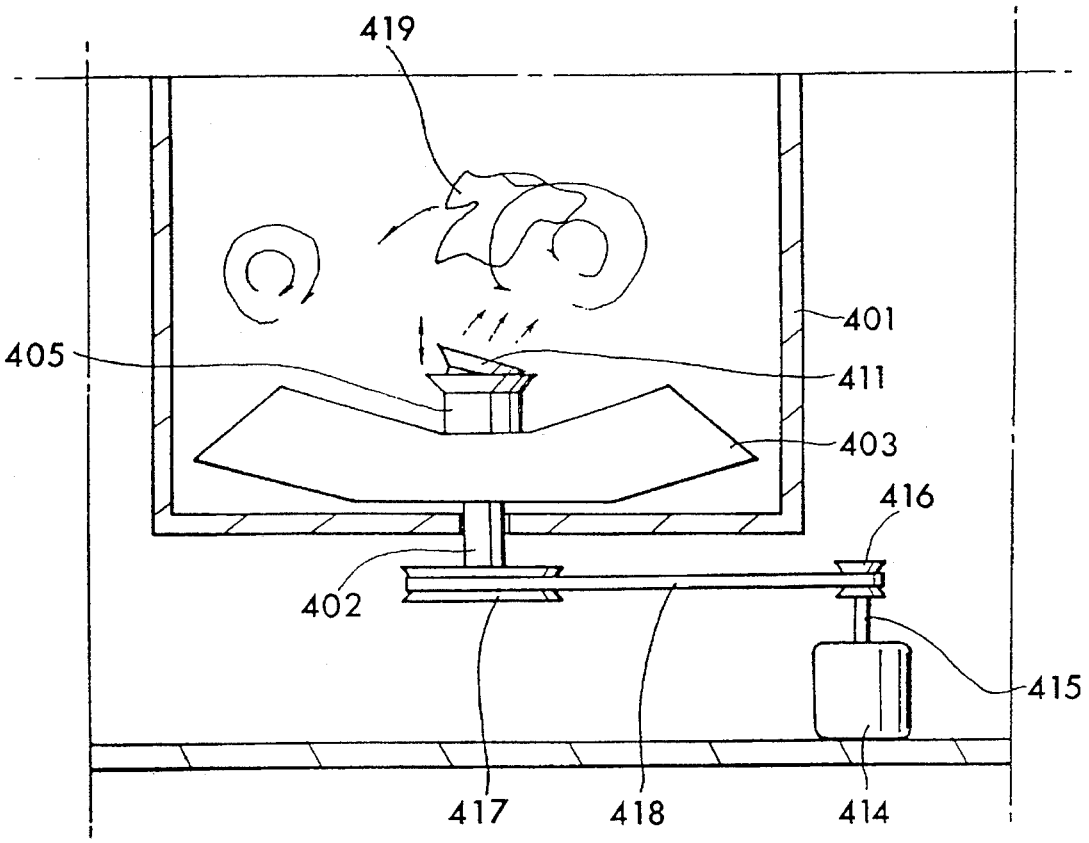
FIG. 10 is a cross sectional view illustrating flow line of the washing water due to the rotating of the pulsator of the fourth embodiment.
Figure 11:
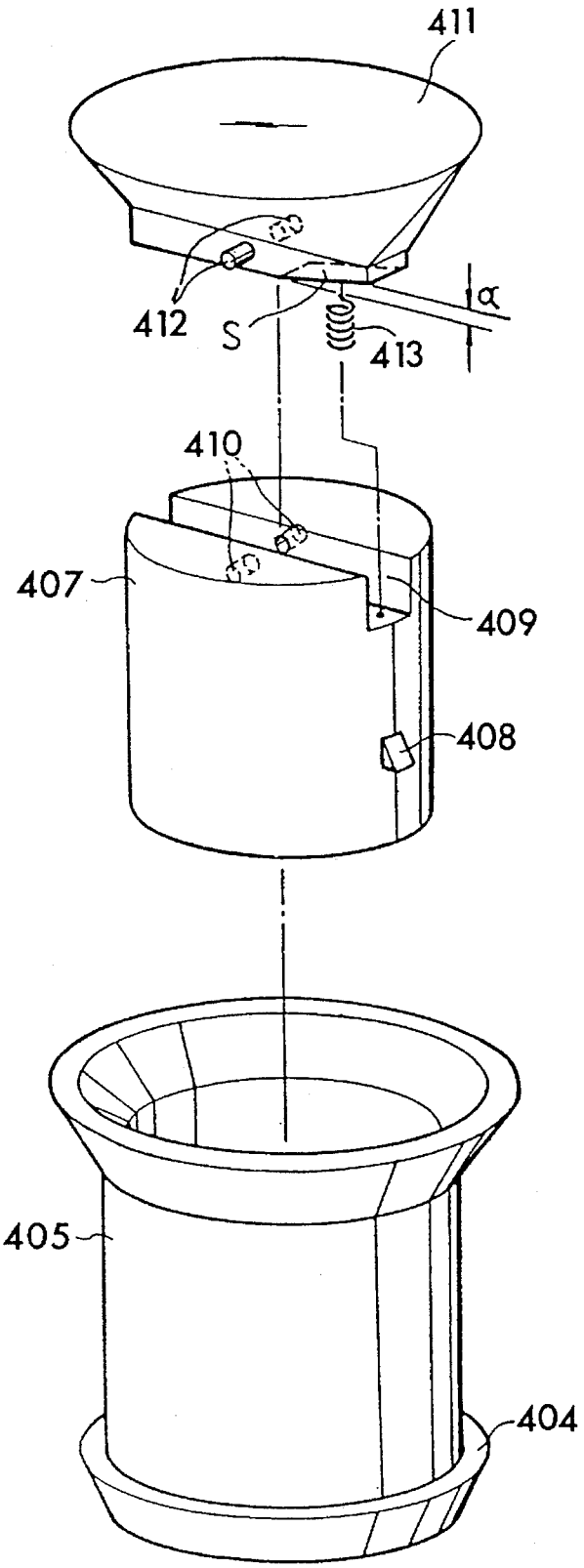
FIG. 11 is an exploded perspective view showing the principal parts of the fourth embodiment.
Figure 12:
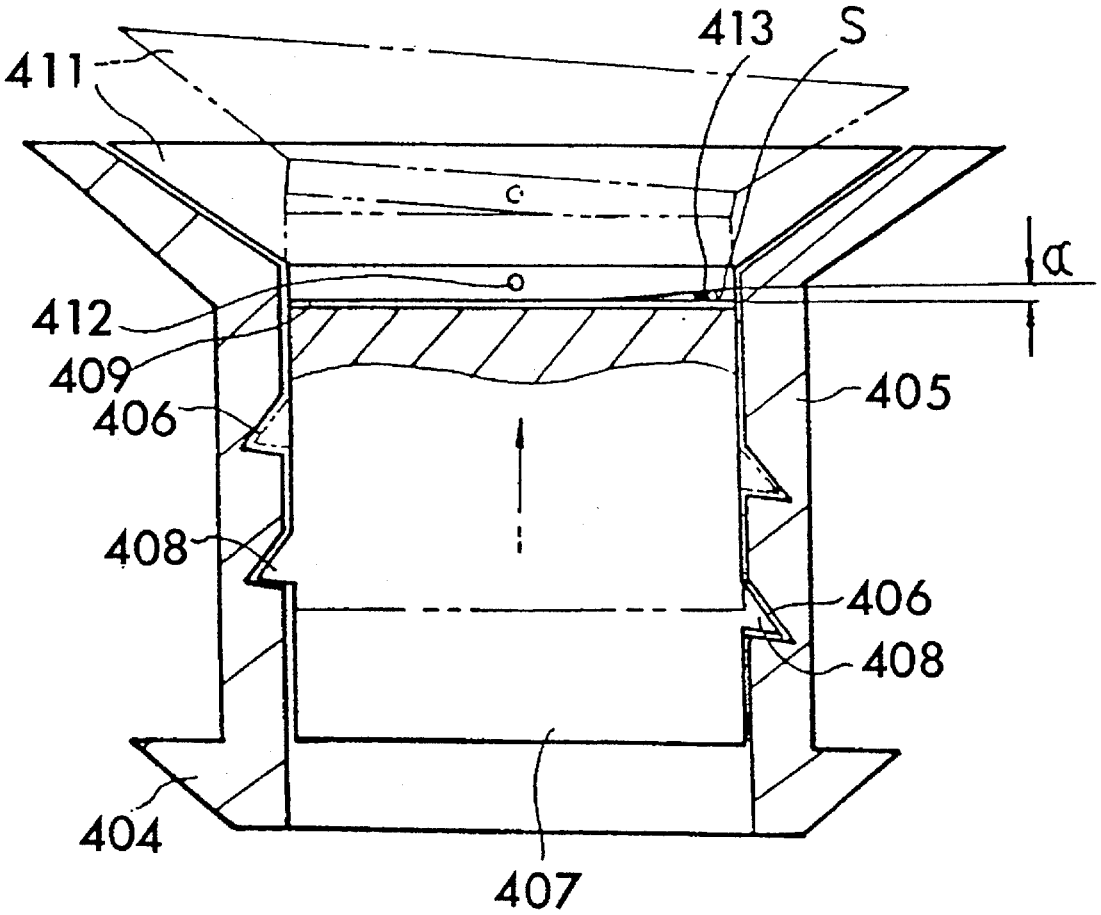
FIG. 12 is a sectional view showing assembled state of the principal parts in FIG. 11.

In addition, the fourth embodiment of the present invention will be described in detail with reference to FIG. 10 through FIG. 12. FIG. 10 is a sectional view of the present embodiment, and FIG. 11 is an exploded perspective view showing the principal parts, and FIG. 12 illustrates the assembled state of the present embodiment. Referring to FIG. 10 through 12, the rotating member 405 in which the fixing part 404 is formed at the lower end thereof and its upper portion is formed to be broadened in its diament gradually toward the upper end is coupled with the pulsator 403 provided in the bottom of the wash tub 401 to generate the water flow, and a spiral groove 406 is engraved on the inner peripheral surface of the rotating member 405. Two guiding protrusions 408,408 formed at both sides of the lower outer surface of the elevating member 407 are inserted into the spiral groove 406 so as to the elevating member 407 moves upwards and downwards along the spiral groove 406. At the middle of the upper end of the elevating member 407 there is engraved an inserting groove 409 having guiding holes 410,410 formed at both sides thereof.

Further, a circular cone-shaped head 411 is disposed on the tapered open end of the rotating member 405, and as the elevating member 407 moves upwards and downwards, the head 411 pivots on shafts 412,412 projected from the both sides of the lower portion thereof. The lower portion of the head 411 is inserted into the inserting groove 409, and the shafts 412,412, then the shafts 412,412 of the head are inserted into the guiding holes 410,410. On the one end of the bottom surface there is formed a slant face S having a predetermined angle α, and a coil spring is provided between the inserting groove 409 and the slant face S for giving elastic force to the head 411.

In the present embodiment, as shown in FIG. 10 through FIG. 12, when the driving motor 414 disposed under the wash tub 401 starts to rotate, the driving force of the driving motor 414 is transmitted to the rotating shaft 402 through the pulley 416 mounted on the upper end of the motor shaft 415, the belt 418 and the pulley 417 mounted on the lower end of the rotating shaft 402, and then the pulsator 403 which is coupled with the rotating member 405 mounted on the upper end of the shaft 402 begins to rotate. At this time, the elevating member 407 whose guiding protrusions 408,408 are inserted into the spiral groove 406 engraved on the inner peripheral surface of the rotating member 405, moves upwards along the spiral groove 406 as indicated by the phantom line in FIG. 12, and also the circular cone-shaped head 411 connected with the upper end of the elevating member 407 moves upwards.

When the head 411 reaches the upper limit, the head 411 becomes to be inclined as indicated by the phantom line in FIG. 12 by the coil spring 413 disposed under the slant surface S having a predetermined angle α. Thus while the head becomes to be inclined to one side, the head beats the washing articles. When the guiding protrusions 408,408 of the elevating member 407 move downwards along the spiral groove 406, the head 411 being inclined restores to the original state and beats the washing articles again so that non-symmetrical water flow is generated by the beating of the head as shown in FIG. 10.

Accordingly, the entanglement of the washing articles can be minimized and the washing is carried out effectively by the non-symmetrical water flow.

Figure 13:
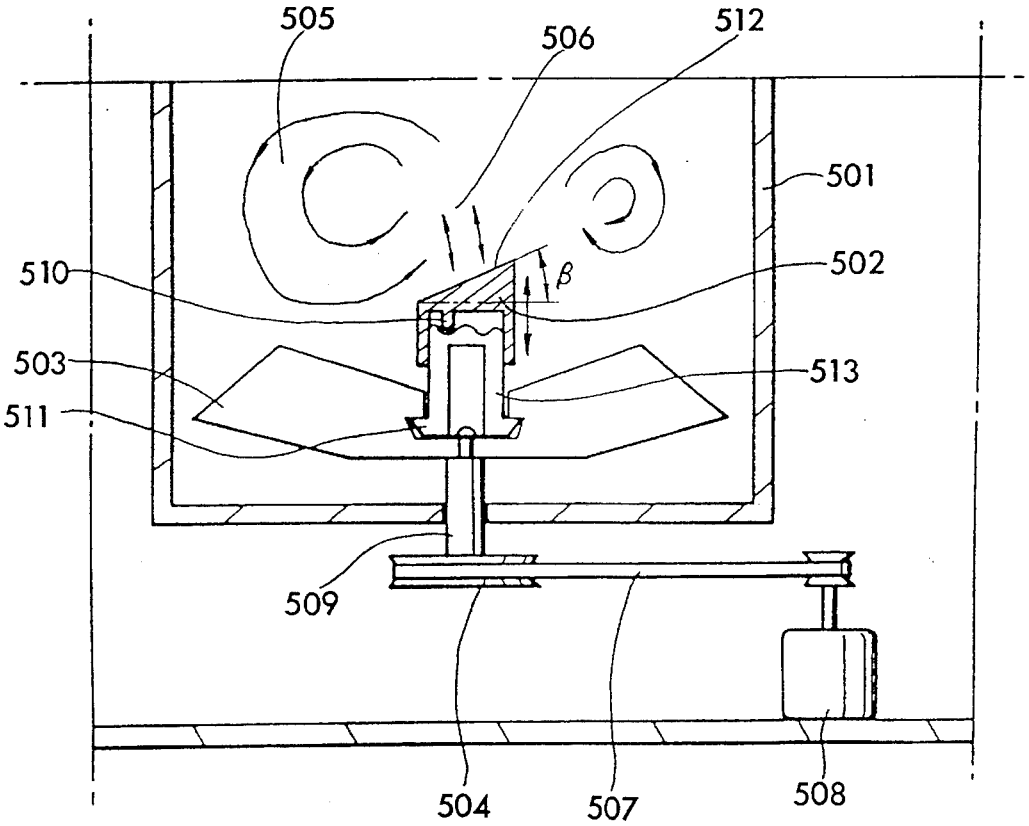
FIG. 13 is a sectional view illustrating flow line of the washing water due to the rotating of the pulsator of the fifth embodiment.
Figure 14:
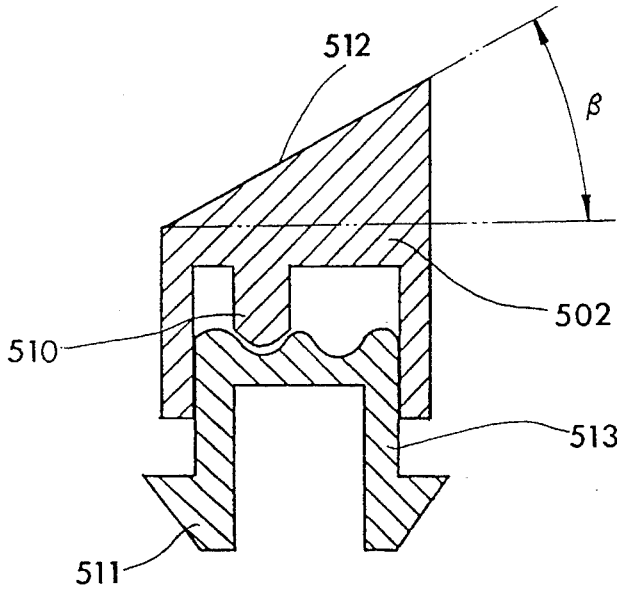
FIG. 14 is a enlarged sectional view showing the engagement of the elevating member and the rotating member is FIG. 13.

Next, the fifth embodiment of the present invention will be explained with reference to FIG. 13 and 14. Referring to FIG. 14, the upper surface 512 of the elevating member 502 is inclined in a predetermined angle β. The rotating member 513, the pulsator 503 and the elevating member 502 are operated in similar manner described in foregoing embodiments.

Therefore, the elevating member 502 is rotated by the driving force of the driving motor 508 which is transmitted through the rotating shaft 509 and the rotating member 513, and the elevating member 502 moves upwards and downwards by the contacts between the guiding protrusion 510 and the dimple formed on the upper surface of the rotating member 513. When the elevating member 502 begins to rotate and oscillate vertically, the non-symmetrical water flow is generated in the wash tub 501 by the operating of the slanted upper surface 512. Accordingly, the entanglement of the washing articles can be minimized, and the washing is carried out effectively by the non-symmetrical water flow.

Figure 15:
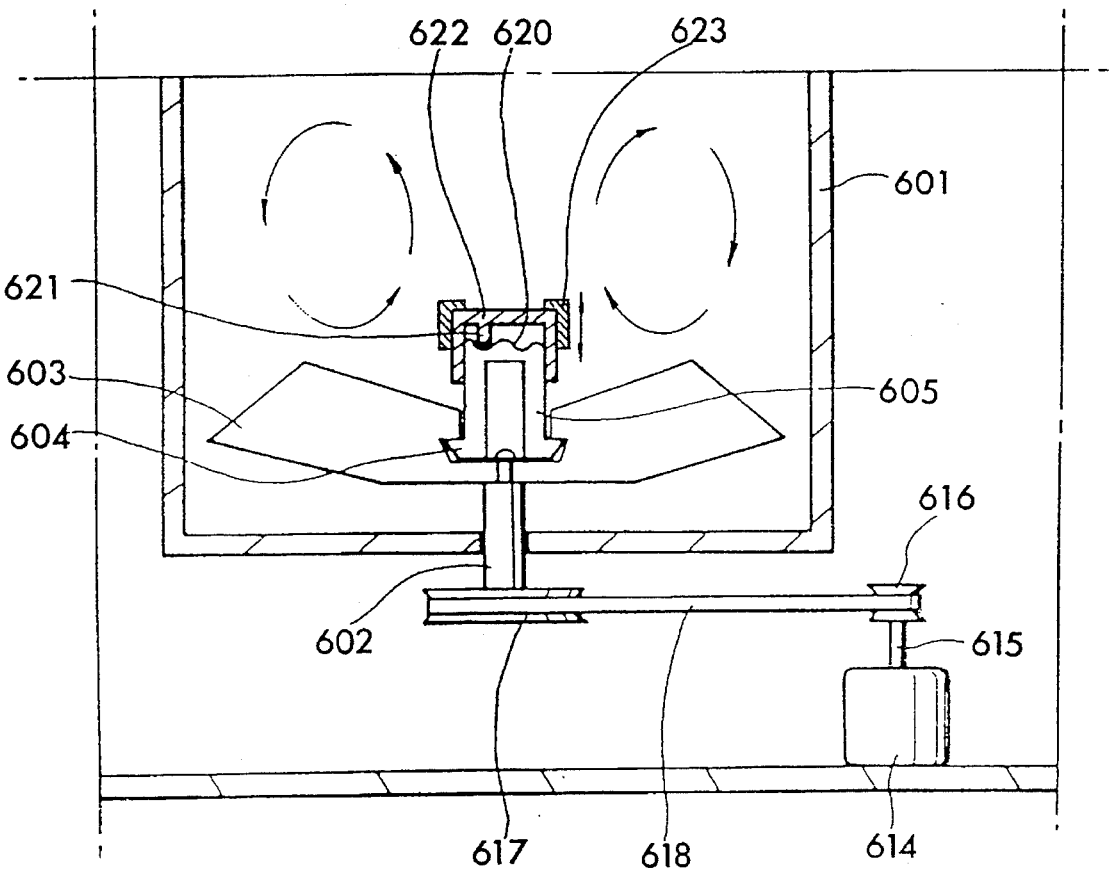
FIG. 15 is a sectional view illustrating flow line of the washing water due to the rotating of the pulsator of the sixth embodiment.
Figure 16:
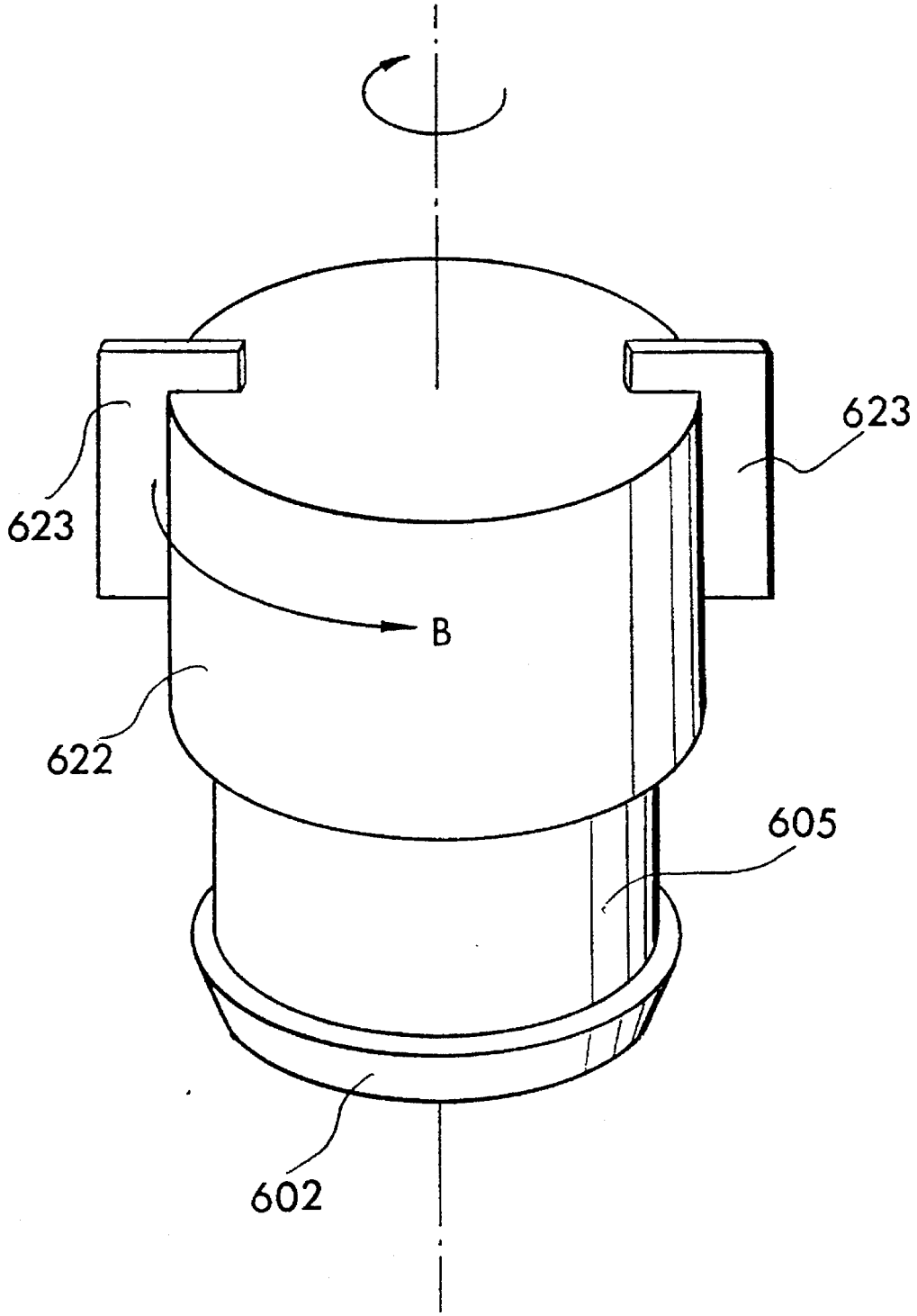
FIG. 16 is a perspective view showing assembled state of the elevating member and the rotating member of the sixth embodiment.

Next, the sixth embodiment of the present invention will be explained with reference to FIG. 15 and 16. Referring to FIG. 16, on the upper outer surface of the elevating member are disposed fins 623,623 maintaining an equal distance to each other. And the rotating member 605, the pulsator 603 and the elevating member 622 are operated in similar manner described in foregoing embodiments.

Therefore, the elevating member 622 is rotated by the driving force of the driving motor 614 which is transmitted through the rotating shaft 602 and the rotating member 605, and the elevating member 622 moves upwards and downwards by the contacting between the guiding protrusion 621 and the dimple formed on the upper surface of the rotating member 605. At this time, the fins 623,623 are struck against the water flow which flows around the elevating member 622 in opposite direction of the rotating, then resisting force acts to the fins 623,623 so as to facilitate the vertical oscillation of the elevating member. Accordingly, the elevating member 622 smoothly moves upwards and downwards, and the entanglement of the washing articles can be reduced.

In the present embodiment, although the elevating member is disclosed as having two fins 623,623, the elevating member may have plural fins or slanted fins.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A washing machine having a punch-washing function comprising:

a rotating member formed in one piece at a central surface of a pulsator; and an elevating member oscillating vertically in conjunction with said rotating member of said pulsator, said elevating member having an inner portion partially surrounding the outer surface of the rotating member, a hollow interior portion adapted to receive said rotating member, and a sliding protrusion adapted to be inserted in grooves of the rotating member, the sliding protrusion projected inwardly from an inner peripheral surface of said elevating member.

2. The washing machine having a punch function as claimed in claim 1, wherein the rotating member has an upper outwardly facing surface containing a dimple.

3. The washing machine having a punch function as claimed in claim 2, wherein the elevating member includes means for moving along the surface of the dimple so that the elevating member moves upwards and downwards.

4. The washing machine having a punch function as claimed in claim 3, wherein the means is a guiding protrusion projected inwardly from the inside of the elevating member.

5. The washing machine having a punch function as claimed in claim 4 wherein said elevating and rotating members each has an interior hollow configuration.

* * * * *